US005186115A

United States Patent [19]

Rouleau et al.

[11] Patent Number: 5,186,115

[45] Date of Patent: Feb. 16, 1993

[54] FABRIC GUIDING DEVICE AND PROCESS OF AUTOMATIC SEWING

[76] Inventors: Alain Rouleau, 3 rue Espinasse; Patrick Rouleau, 52 boulevard Carnot, both of 31000 Toulouse; Jean-Pierre Touret, Route de Menville - Bretx, 31530 Levignac, all of France

[21] Appl. No.: 736,634

[22] Filed: Jul. 26, 1991

[30] Foreign Application Priority Data

Jul. 27, 1990 [FR] France ..... 90 09728

[51] Int. Cl.[5] ..... D05B 27/04; D05B 27/10; D05B 35/10; D05B 19/00

[52] U.S. Cl. ..... 112/306; 112/121.11; 112/153; 112/262.3; 271/227; 271/251

[58] Field of Search ..... 112/306, 318, 322, 153, 112/308, 309, 121.11, 262.3, 262.1, 121.12; 271/225, 227, 251

[56] References Cited

U.S. PATENT DOCUMENTS 4,719,864 1/1988 Barrett et al. ..... 112/153 X
4,730,824 3/1988 Huau et al. ..... 271/227
4,776,579 10/1988 Romand et al. ..... 271/227 X
4,825,787 5/1989 Babson et al. ..... 112/306 X
4,836,119 6/1989 Siraco et al. ..... 112/306
4,887,810 12/1989 Grutzmacher et al. ..... 271/225

*Primary Examiner*—Peter Nerbun
*Attorney, Agent, or Firm*—William R. Hinds

[57] ABSTRACT

A process and device are disclosed for automatic sewing of a piece of fabric along its edges. The process is of the type in which a rolling element (12) orientable by pivoting around a vertical axis YY' bears against the fabric in front of the presser-foot in order to guide and entrain the fabric in front of the sewing zone. The rolling element (12) is driven into rotational movement by a cylinder (16) bearing against that element in its upper zone traversed by the pivoting axis YY' in such a manner that the contact of the cylinder against the rolling element leaves this latter free to pivot, especially at high frequency, about the axis YY' independently of the value of the friction coefficient between the cylinder and the rolling element.

16 Claims, 11 Drawing Sheets

Figure 1:
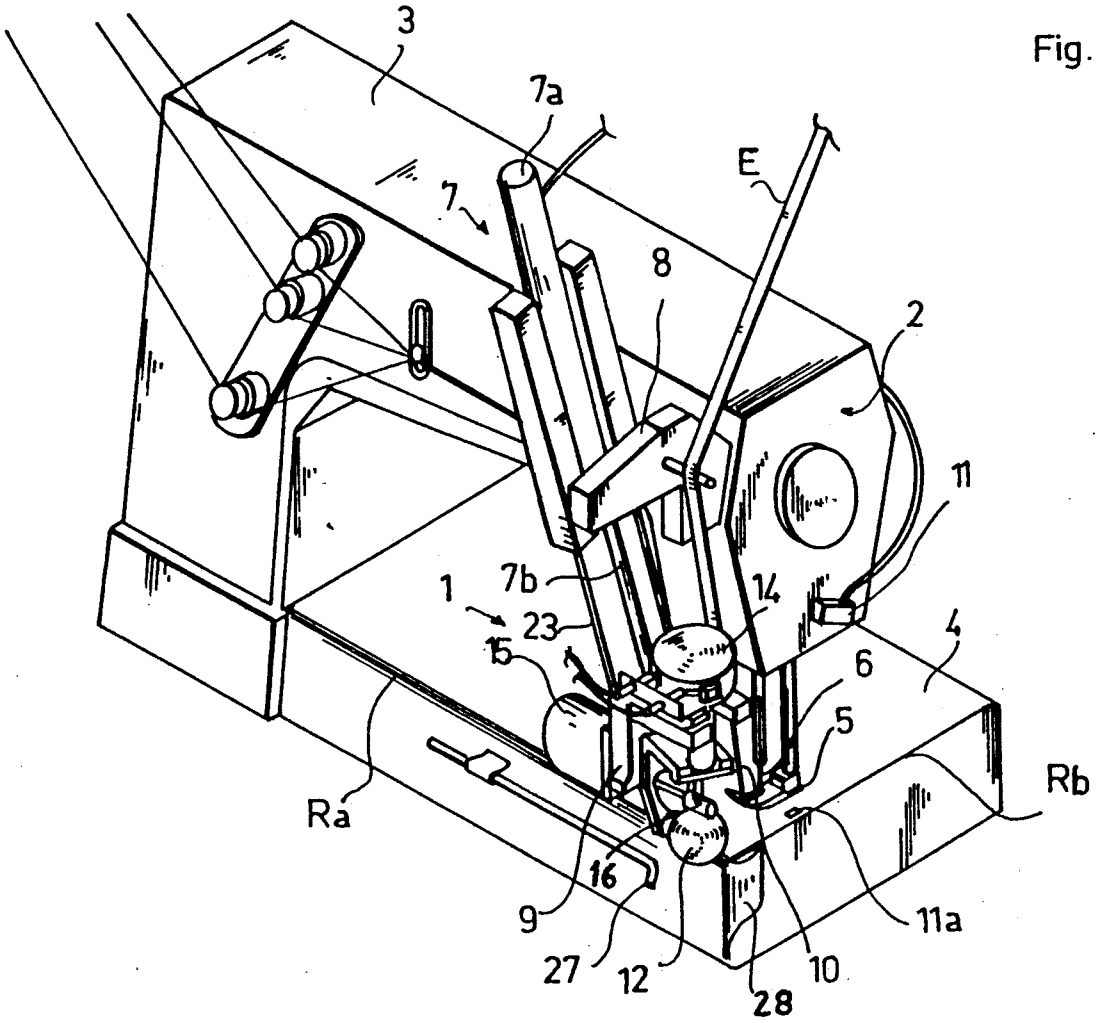

2
10
Y
14
14a
11
9
15
14b
22
16
Z
Z'
13
Su
12
X
X'
21
Y'

FABRIC GUIDING DEVICE AND PROCESS OF AUTOMATIC SEWING

The invention relates to a device for guiding a piece of fabric parallel to a pre-determined reference line, consisting in particular of the edge of the fabric; it relates to a device adaptable to a sewing machine of the traditional type comprising more specifically a needle plate, and a mechanism with claws for advancing the fabric, associated with at least one needle; in the following the mechanism and its accessories will be designated by the term "presser foot". The invention also extends to a method of automatic sewing of a fabric, by means of a sewing machine equipped with such a guiding device. It extends further to the improved sewing machines equipped with one or more guiding devices in accordance with the present invention.

In the garment trade, the operations of sewing pieces of fabric or material are usually directed to the sewing of two pieces of material along their edges or of making a hem at the edge of one piece of material or for fitting a ribbon, rubber band, a belt, etc. along an edge of one piece of material. These operations require the presence of an operator who guides the fabric in front of the needle in such a manner that the seam follows the desired line. In order to achieve economy in working personnel and improve the productivity, there has been proposed a guiding system which displaces the fabric in a transverse direction in front of the needle in order to constantly bring the region to be sewn next to the needle; these systems generally comprise rollers or chains on rollers arranged transversely in front of the needle; these rollers or chains can be rotated in one direction or the other so as to move the fabric transversely in the two directions and thus to carry out appropriate corrections of the positions. However, these systems are barely used because they lead to imperfect seams and to frequent defects; indeed, the material or fabric pushed by the presser-foot at the level of the needle, is braked by the guiding system before reaching the needle and has thus a tendency of rolling on itself, of folding or creasing in a manner which is incompatible with obtaining a regular seam of good quality; this defect is particularly grave in the case of extendible fabrics or fabrics with "soft eyes" which cannot be sewn with the known systems; in the case of two pieces of material to be assembled edge to edge, it leads to the displacement of one edge with respect to the other and to imperfection of the assembling which prejudices the quality of the product obtained. Moreover, most of the existing systems can be used only for fabrics of a definite thickness.

French Patent 2,585,683 and European Patent 0,216,644 describe a guiding device for a fabric which comprises a spherical roller which bears against a fabric in front of the presser foot and rotates in a single rotation sense in order to guarantee advance and guiding of the fabric on top of the sewing zone; this spherical roller is pivotally mounted around a vertical axis in such a manner that it can be oriented in different directions of entrainment permitting to bring the fabric into the desired position. In the device in accordance with these patents, the spherical roller rotates by friction with another roller which bears against one of its sides in the horizontal plane containing the axis of said first roller. As explained in these patents (especially page 6, line 32 to page 7, line 35 of French Patent 2,585,683), the entrainment roller turns at a constant speed and its arrangement with respect to the spherical one (sidewise contact in the horizontal plane containing the axis of rotation of the spherical roller), provides an automatic modulation of the rotation speed of said roller when this latter changes its orientation: in fact, the roller entrained at a constant rotation speed guarantees at the contact level a constant tangential speed of the spherical roller; when this latter takes an oblique orientation with respect to the other roller (axis of the roller and the spherical roller not parallel), the spherical roller entrained in circles of a smaller diameter, turns at a greater speed. This effect is favorable because the spherical roller entrains the fabric at a greater resultant speed whose component along the direction of entrainment of the presser-foot is constant no matter the orientation of the spherical roller; this component can thus be brought to coincide permanently with the entrainment speed of the presser-foot by adjusting once and forever the rotation speed of the second roller to a pre-determined appropriate value.

However, the reduction to practice of such a system met with great difficulties. In order to permit a satisfactory entrainment of the spherical roller by the second roller, it is necessary that the surfaces of these two elements should roll without sliding against each other, and thus present a sufficient friction coefficient; when the spherical roller pivots around the vertical axis in order to adopt another orientation, the contact region of the second roller on this first roller describes a segment of a great circle and this movement is transverse with respect to the second roller (parallel to the axis of the second roller and perpendicualr to the tangential speed), in such manner that the friction between the two surfaces has a tendency to oppose the movement. Under these conditions, the pivoting movements of the spherical roller, in order to modify its orientation, require considerable forces and must, therefore, be slow with respect to the rotation speeds of the second roller and of the first one thus producing rapid wear of the surfaces, which requires frequent replacement of these elements.

Thus, the problem of automatic sewing in the garment field is at present not solved in a satisfactory manner and the need for a full-time operator for each sewing machine, constitutes an impediment for equilibrating the job positions and increasing profit by increased productivity.

The present invention proposes to provide a solution to the above mentioned problem. It is directed to a process for guiding the material and an improved device for achieving this, of the type containing a moving element which moves in a single sense, namely a sphere which is made to pivot around a vertical axis in order to orient it in relation with the directions of advance of different materials. The invention also relates to the mounting of one or more of these improved devices on a sewing machine of the known type (provided with a support plate and a presser-foot associated with at least one needle) in order to permit to sew automatically pieces of material parallel to a predetermined reference line, constituted in particular by the edge of such pieces. The invention is applicable to any object of the seam, namely: fitting of a ribbon, a belt, or a rubber band at the edge of a piece of fabric, sewing of a hem (the machine being provided with a conventional folding device), sewing together of two pieces of material (the machine being provided with two guiding devices).

The object of the invention is to permit obtainment of a regular seam of good quality, independently of the type of fabric (namely, fine fabrics difficult to handle, extendible fabrics . . . ) by overcoming the performance of difficulties encountered by the devices of the same type described in the above mentioned patents.

Another object of the present invention is to provide a guiding device of a simple structure which, mounted on a sewing machine of conventional type, permits automatic sewing of materials of any thickness.

Certain terms used in the following are defined below in order to simplify the terminology and make the description clearer:

"Piece of fabric": piece of fabric or of any similar material susceptible to sewing, "longitudinal" direction: direction of the line of sewing desired, "general longitudinal direction": the direction which may be angularly decalated with respect to said longitudinal direction at an angle of less than 30° but whose general orientation is longitudinal, "transverse direction": direction perpendicular to the longitudinal direction, "vertical"direction: direction orthogonal to the sheet of material (or to the supporting plate of the sewing machine which supports the material), "horizontal" direction: direction parallel to the sheet of material (or to the supporting plate of the sewing machine), "presser-foot": assembly of the classic mechanism which guarantees the guiding and advance of the fabric or material at the level of the needle.

The process in accordance with the present invention is of the type in which a rolling element, orientable by pivoting around a vertical axis, bears against a fabric in front of the presser-foot in such a manner as to guide and entrain the fabric in front of the sewing zone; the process in accordance with the present invention is characterized in that said rolling element is driven to a rotational movement by a cylinder bearing against that rolling element in its upper zone traversed by the vertical pivoting axis in such a manner that the contact of the cylinder against the rolling element leaves this latter free to pivot around the vertical axis, independently of the value of the friction coefficient between the cylinder and the rolling element.

Moreover, in accordance with another characterising feature of the process, the cylinder is made to rotate at a variable speed which is a function of the orientation of the rolling element in such manner that said rolling element creates a speed of advancement of the fabric whose projection on the sewing line is substantially equal to the advance speed provided by the pressure-foot in the sewing zone.

The fabric guiding device in accordance with the present invention, in order to carry out the process described above, comprises:

a rolling element for entrainment of the fabric, mounted in front of the presser-foot and free to rotate around a substantially horizontal axis in such a manner as to be able to get into contact with the fabric by entrainment generatrices situated in a vertical plane, a pivoting actuator on which said rolling element is mounted, adapted to make this latter pivot around a vertical axis, intersecting the rotation axis in such a manner as to be able to direct the entrainment generatrices in accordance with different advance directions, a cylinder situated along a transverse horizontal axis and bearing against the rolling element in order to make this latter turn around its axis of rotation, by friction, a drive-motor for causing rotational movement of the cylinder, a detector of the transverse position of the fabric, mounted in front of the presser-foot and associated with means for generating a position signal and with control means adapted to actuate the pivoting as a function of the position signal.

In accordance with the present invention, the cylinder is situated on top of the rolling element in such a manner as to bear against the upper zone thereof, opposite the contact zone of said element with the fabric, the contact zone of said cylinder with said rolling element being substantially situated on the vertical axis around which the pivoting of said rolling element occurs.

Thus, in the present invention the fabric is entrained longitudinally in a permanent manner in front of the guide zone and the corrections, of the position are effected by orienting, in appropriate manner, the direction of this longitudinal entrainment; the rolling element is rotated by the cylinder by friction at the level of a zone which is not subject to any displacement during the pivoting of this element, in such manner that the unavoidable friction between the two surfaces of said elements has no substantial influence on the pivoting movement which can be carried out without particular difficulties.

Moreover, in accordance with other characterizing features, an orientation detector is associated with the pivoting actuator (or with the rolling element), said detector being connected with means for creating a signal adapted to deliver a signal representative of the direction of advance of generatrices of the rolling element, the motor causing the rotation of the cylinder being connected with control means receiving the signal emitted by the above mentioned orientation means, said actuating means being adapted for adjusting the rotation speed of the motor as a function of this signal.

It is thus possible, by modulation of the speed of the cylinder, to ensure an advance movement of the fabric at the level of the rolling element, which corresponds to that in the fitting zone of the presser-foot and this no matter the direction of entrainment of the rolling element, in order to avoid any risk of bending, creasing, etc. of the fabric.

In accordance with a preferred embodiment permitting to carry out automatic sewing of a piece of fabric along one of the edges (constituting the above mentioned reference line), the guiding device in accordance with the present invention is designed in the following manner:

the position detector is a detector of the presence or absence of the fabric, associated with means generating a position signal in two representative stages, namely, absence or presence of the fabric, the pivoting actuator is an actuator with alternating pivoting adapted to bring the rolling element to pivot alternatively between two extreme positions at a frequency superior to five pivoting movements per second, the entrainment generatrices presenting in the two extreme positions, two directions substantially symmetrical with respect to the direction parallel to the advance direction of the fabric by the presser-foot, the means for actuating the pivoting actuator being adapted to move this latter alternatively from one position to the other at each change of state of the position signal, the orientation detector being a detector of extreme positions, associated with the actuator of the pivoting movement, the means for carrying out being adapted to deliver a signal of extreme positions when said actuator is positioned in one of these extreme positions, the electric drive motor of the cylinder being of the type having two rotation speeds, one slow and the other rapid, the means of actuating associated with the motor being adapted to actuate the rapid rotation of the motor in the presence of the signal of the extreme position and the slow rotation in the absence of said signal.

In such a device, the pivoting actuator which may be a rotating displacement device, is alternatively actuated between two opposed angular positions depending on the state of the position signal. When the rolling element is situated in one or the other of these extreme positions, it carries out a correction on the fabric by introducing a transverse component into the advance speed at its level: moreover, the cylinder is driven in this case at a rapid speed by the driving motor (presence of extreme position signal) so that the transverse component of the speed is not created at the detriment to the longitudinal component. When, on the contrary, the fabric is in a substantially correct position, the position signal changes very rapidly its state and the displacement device, actuated at an elevated frequency, oscillates between the above two extreme positions. During these oscillations, the fabric is entrained by the entrainment generatrices in accordance with a very rapid succession of zig-zags of very small amplitude around a median direction; it thus moves along a resultant direction, which is parallel to the entrainment direction of the presser-foot; in this case, the detector of the extreme positions, does not supply any signal and the cylinder is driven at low speed by the driving motor; the rolling element moves more slowly, the low speed of the cylinder being controlled in such a manner that the rolling element gives rise to an advance movement of the fabric substantially equal to that caused by the presser-foot. On the contrary, the rapid speed of the rolling element is adjusted for producing a resultant speed of advance of the fabric of the order of 1% to 5% superior to the slow speed, so that the projection of this rapid speed on the longitudinal plane be substantially equal to said slow speed. By means of a very simple device an advance of the fabric in front of the fitting zone is thus obtained, which is at all times compatible with the advance created by the presser-foot.

It should be noted that the above described mode of operation, involving alternative pivoting movements at high frequency, is caused by the manner of driving the rolling element in accordance with the present invention (contact of the driving cylinder on the vertical axis around which the pivoting movements are effected); this mode of operation is definitely incompatible with the manner of operation described in the two above mentioned previous patents.

Moreover, in accordance with other characteristics of the present invention, the rolling element comprises a sphere of elastic material adjusted by a lateral calotte of its surface on a bearing shaft. This bearing shaft is mounted on the pivoting actuator in such a manner as to turn around the horizontal axis of rotation, which passes through the center of the sphere. The center of the sphere and the upper zone of contact between the cylinder and the sphere, are substantially aligned on the vertical axis around which the alternative pivoting movements of said sphere are carried out. These arrangements permit the rolling element to pass, without difficulties, the thicker portions of the fabric, without need to control the bearing pressure of this element (as is the case in the devices described in the above mentioned patents).

Moreover, in accordance with another advantageous characteristic of the invention, the guiding device mentioned above is supported by a mobile lifting/lowering element of a jack whose body is attached to the bed of the sewing machine, in order to permit lowering of the guiding device in working position in front of the needle or lifting it into high position in such manner as to clear the portion in front of the needle. It is thus possible, to completely liberate the bearing plate of the sewing machine before and after the sewing operation in order to carry out the various operations of putting the fabric in fitting position or withdrawing it.

The invention also comprises the guiding device defined above as such, as well as improved sewing machines equipped with at least one such guiding device.

Figure 2:
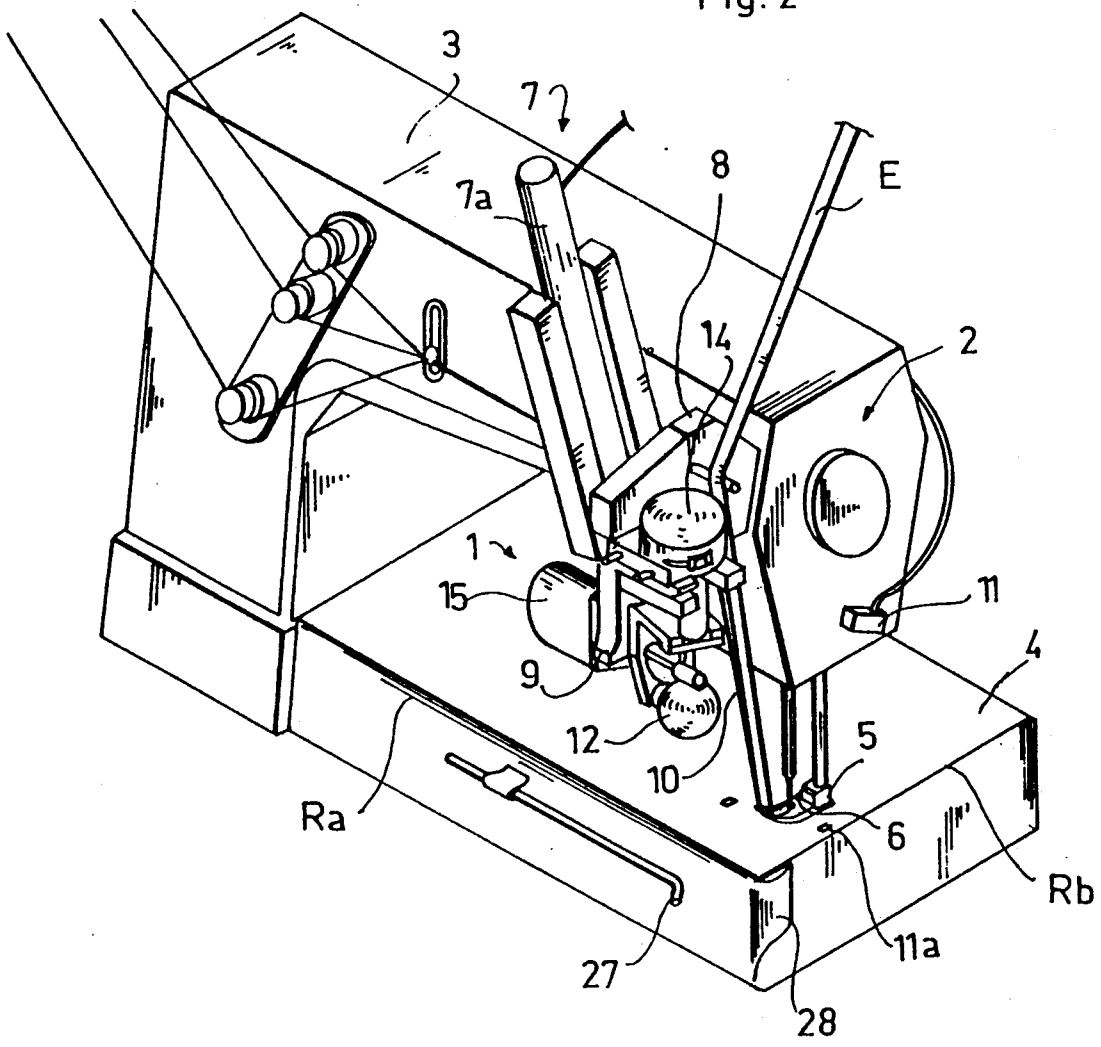
Figure 3:
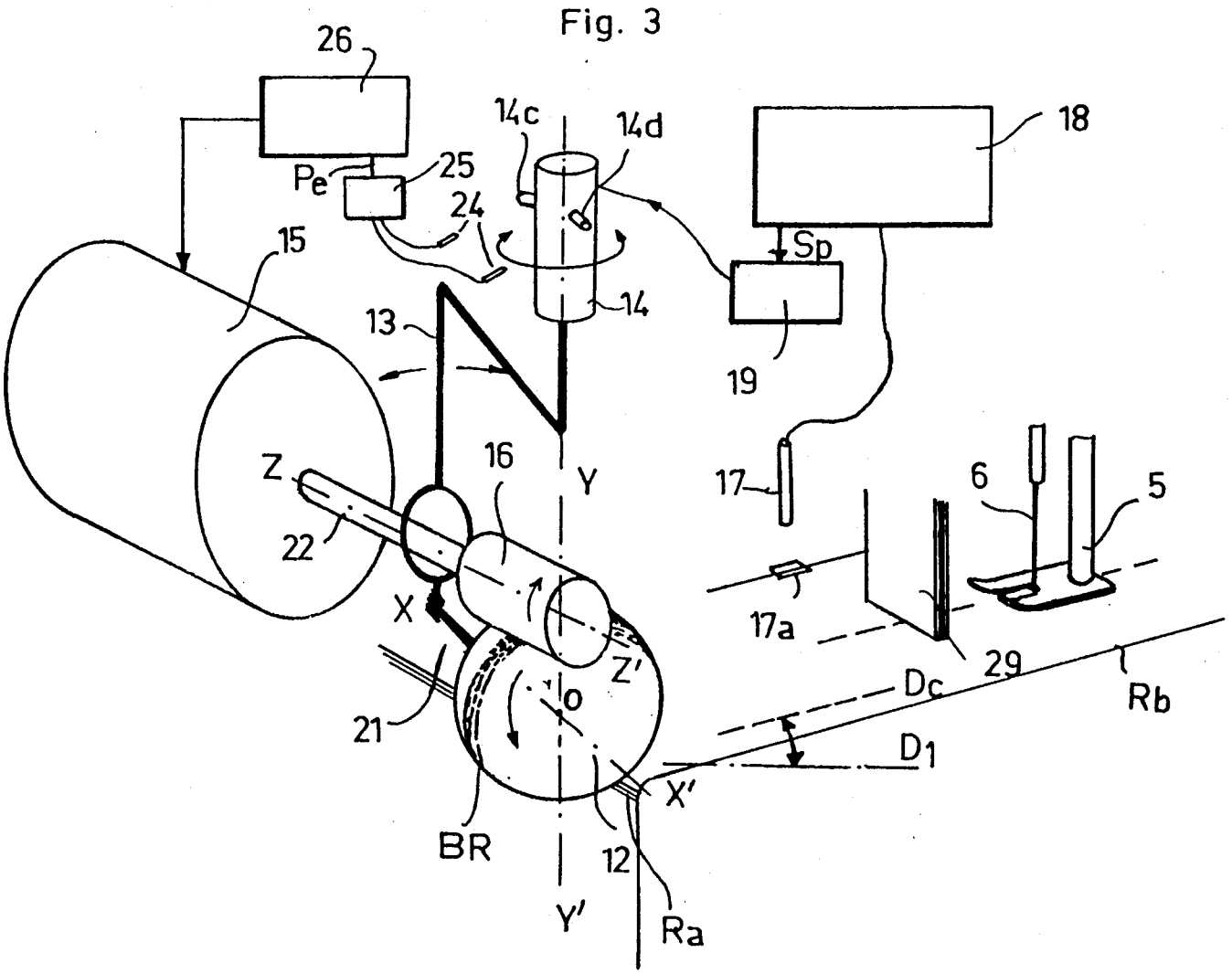
Figure 4:
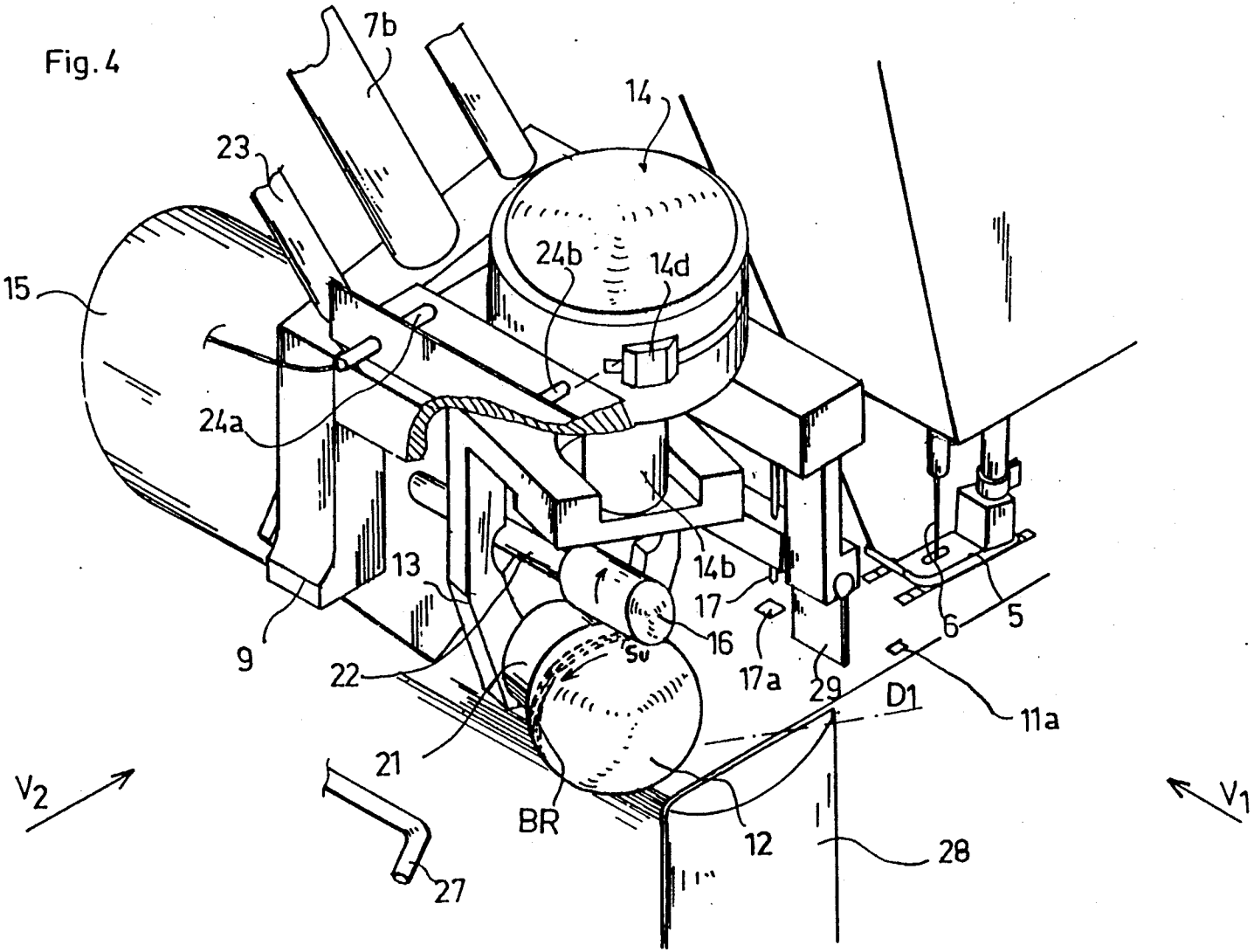
Figure 5:
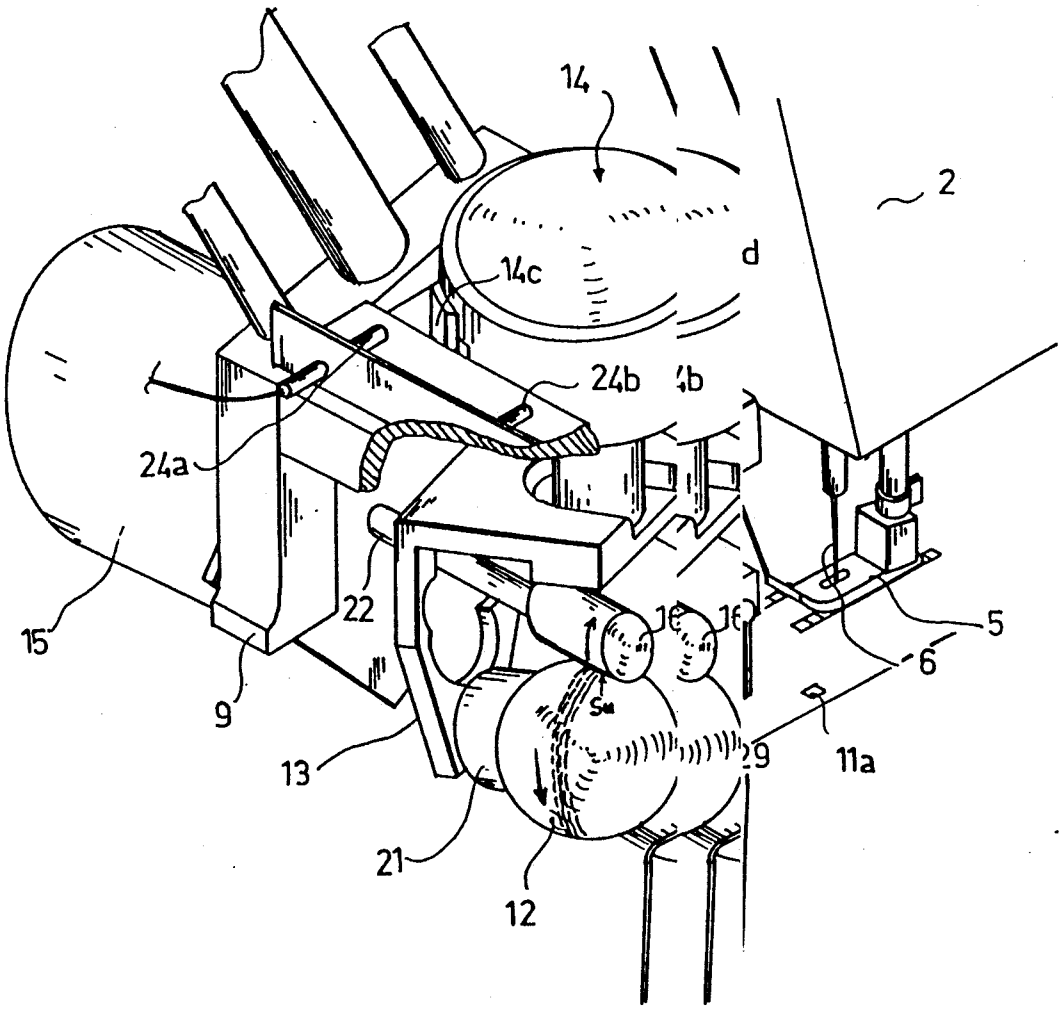
Figure 6:
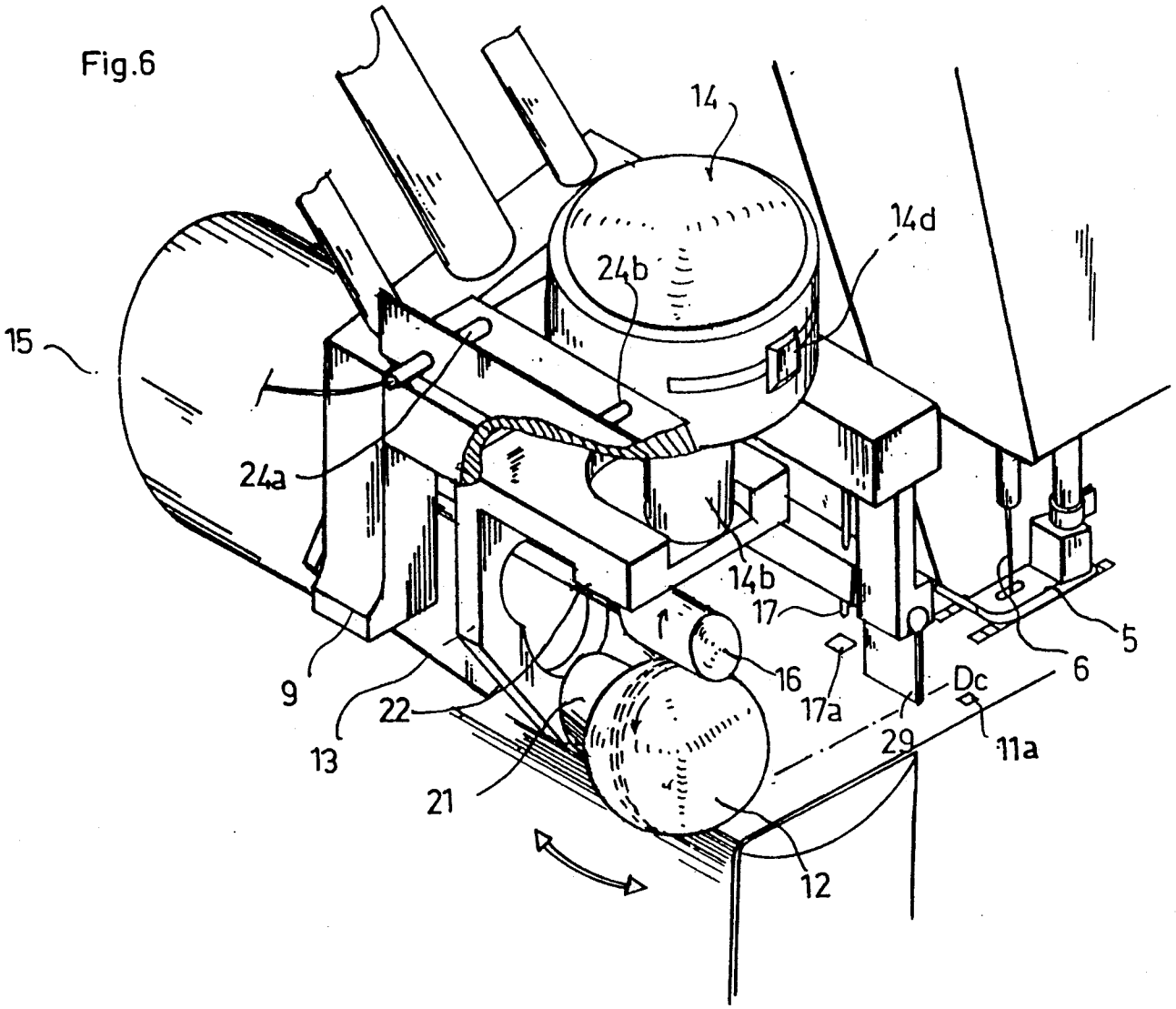
Figure 7:
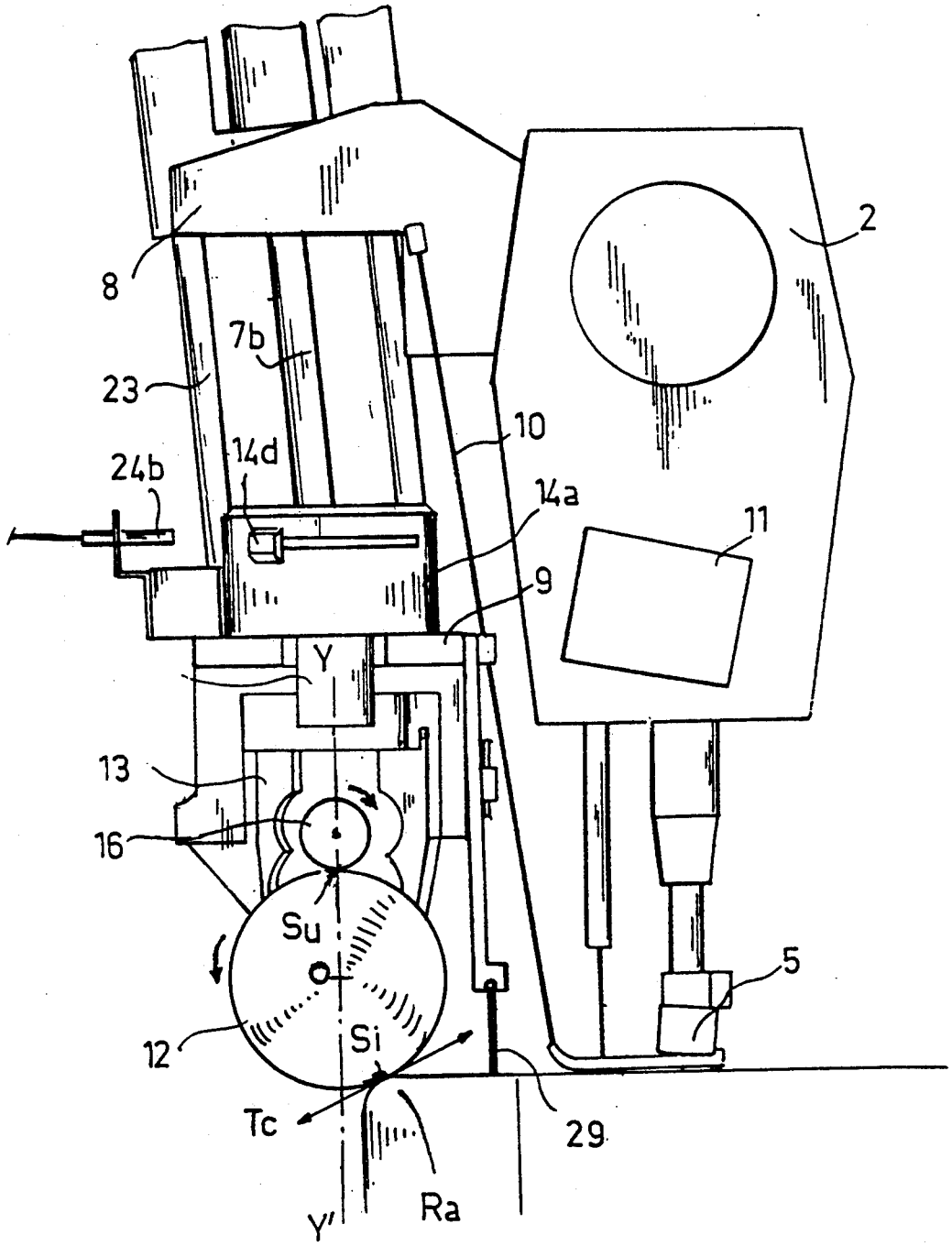
Figure 8:
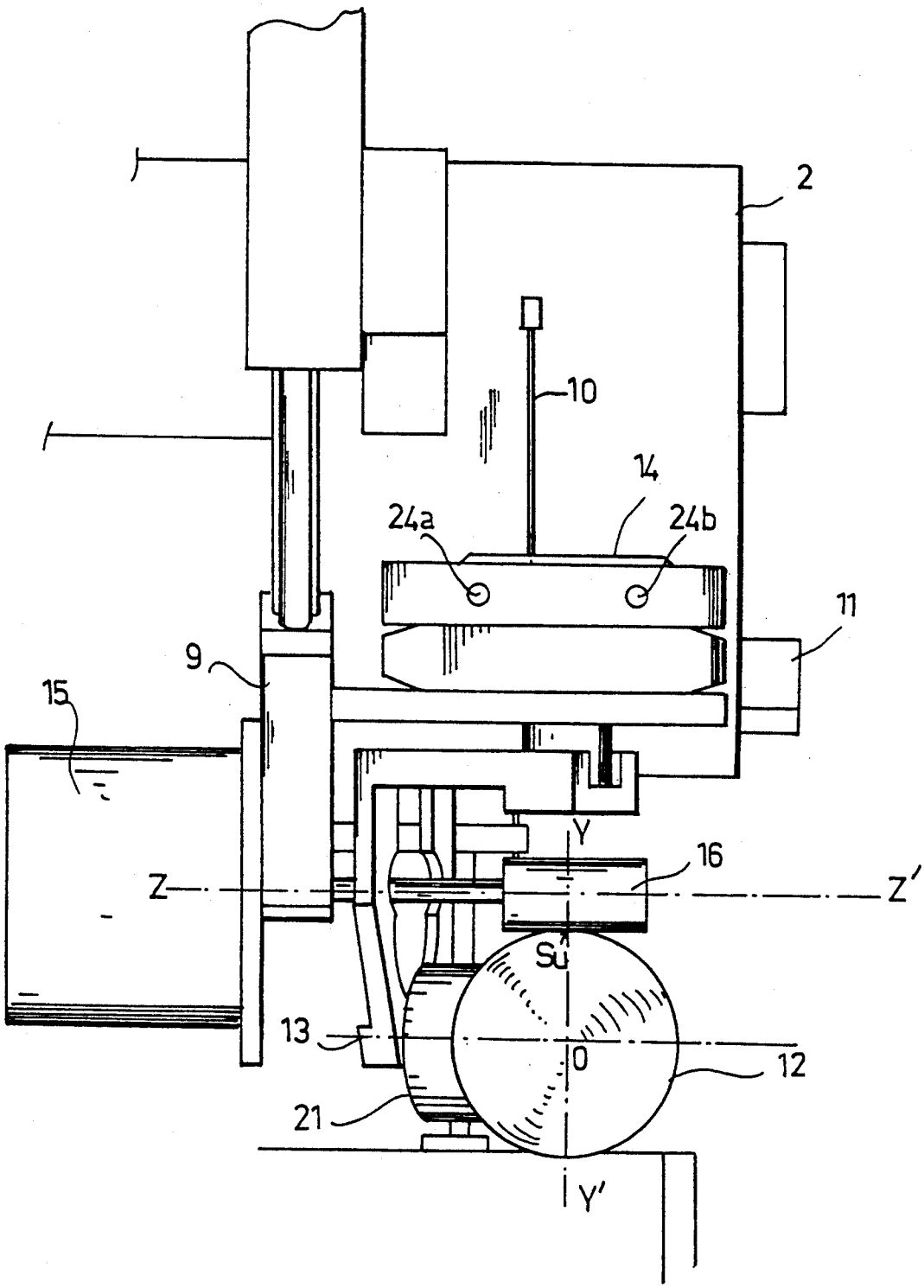
Figure 9:
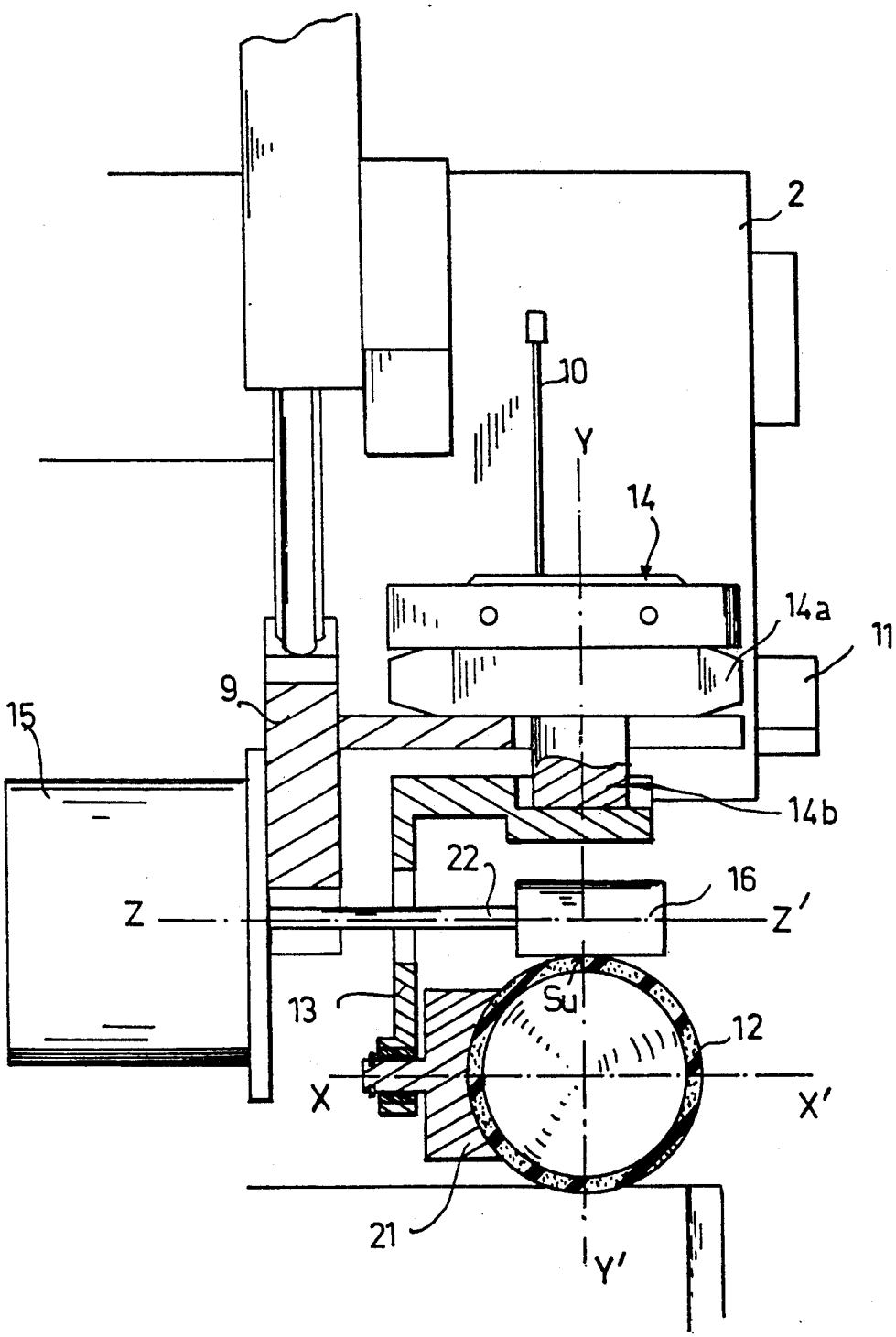
Figure 10:
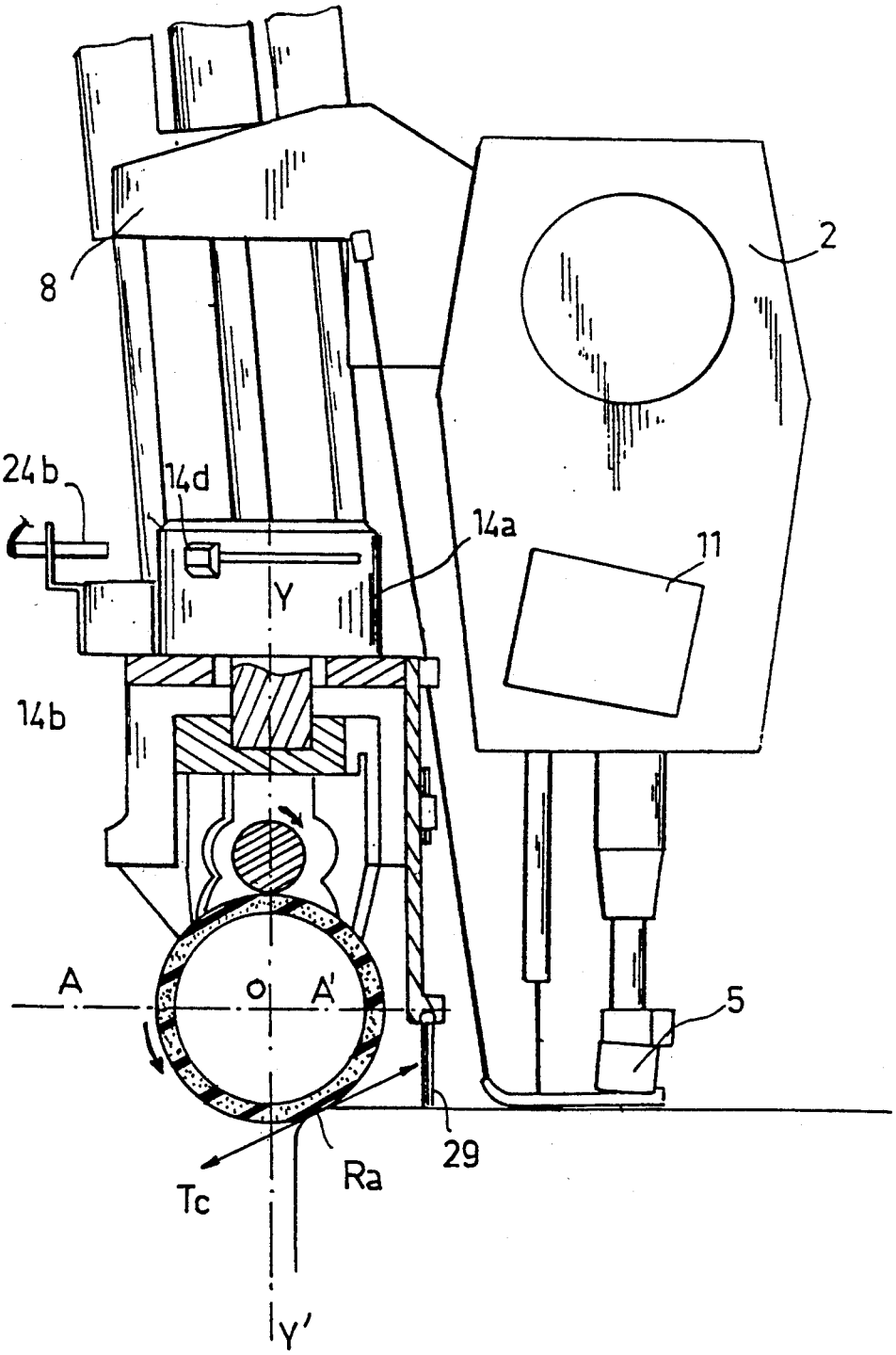
Figure 11:
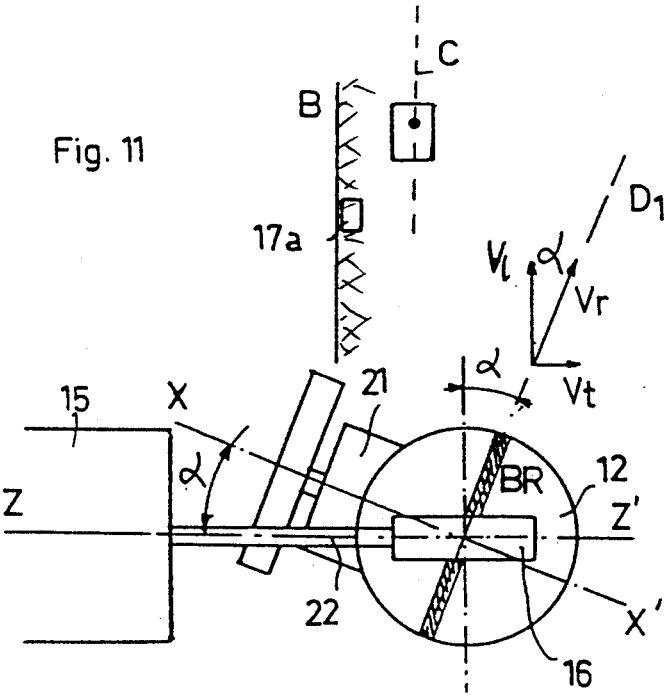
Figure 12:
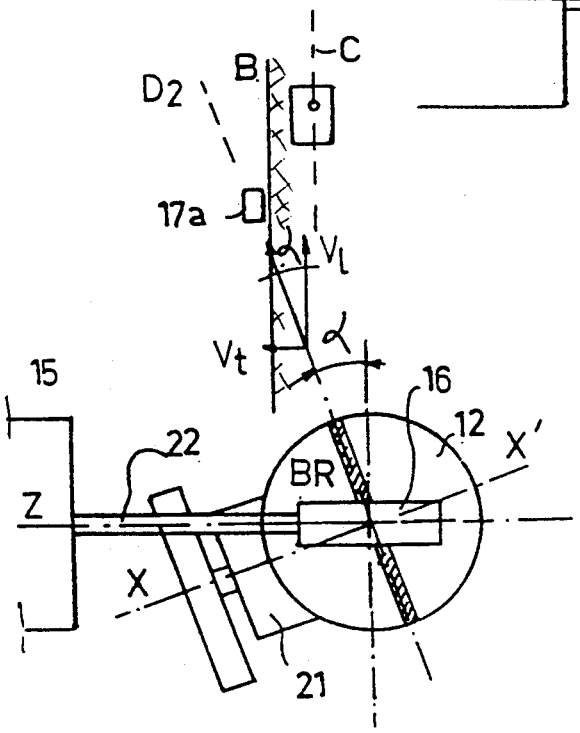
Figure 13:
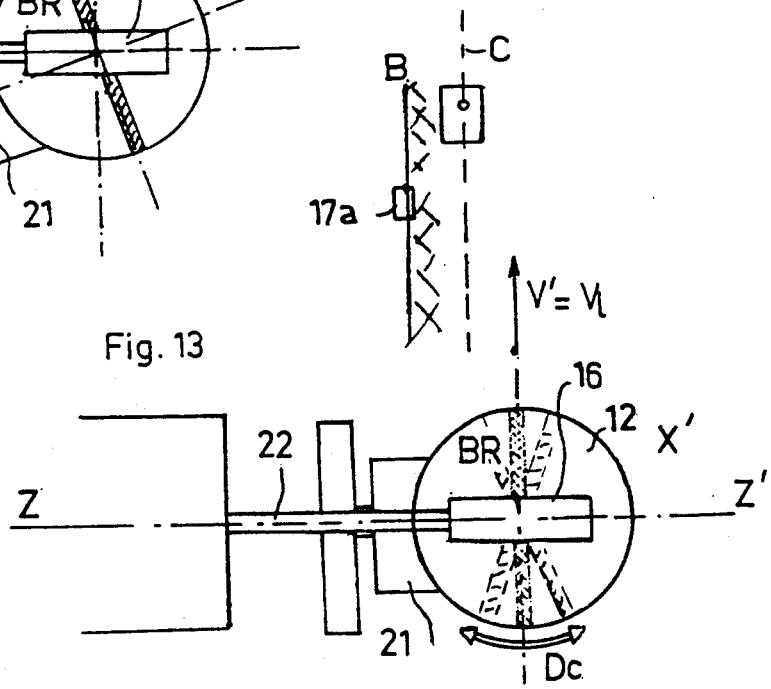

The invention having been described in its general outline, other characteristics, aims and advantages will result from the following descriptions with reference to the attached drawings which represent, in a non-limiting way, an embodiment of the invention; in these drawings which form an integral part of the present invention:

FIG. 1 is a general perspective view of a sewing machine equipped with a guiding device in working position, FIG. 2 is an analogous view showing the guiding device in lifted position, FIG. 3 is a synoptic scheme showing the elements of the guiding device and their functional arrangement, FIGS. 4 and 5 are perspective views of the guiding device showing it in working position, respectively for one and the other of the two extreme orientations of its rolling entrainment element, FIG. 6 is analogous to the two preceding ones, but in which the rolling element is in an intermediate position, FIG. 7 is an elevational side-view of the guiding device in the direction of the arrow $V_1$ in FIG. 4, FIG. 8 is a front elevational view in the direction of the arrow $V_2$ in FIG. 4, FIGS. 9 and 10 are partial cross-sectional views through vertical planes passing respectively through the rotation axis XX' of the rolling element and through a perpendicular axis AA', Finally, FIGS. 11, 12 and 13 are partial plan views of the device, respectively for one and the other of the two extreme orientations of its rolling element and for the intermediate orientation of the latter.

The guiding device 1 represented in FIGS. 1 to 13 is mounted on a sewing machine 2 of the type having the head at the left side; in a conventional manner, this machine comprises a bed 3, a support plate for the work piece 4 and a presser-foot 5 associated with the needle 6 with their conventional kinematics of engagement (claw type advance mechanism), means for distribution of the thread etc. The embodiment exemplified herein is intended for sewing an elastic ribbon of a belt E to the edge of a piece of fabric, and the machine is provided with conventional means for supplying and guiding the elastic ribbon towards the sewing zone (not represented). In the sewing machine with the head at the left which is used, the presser-foot 5 is arranged adjacent to an angle of the support plate 4; this angle is limited by a rounded edge Ra and by an edge Rb perpendicular to the previous one (parallel to the line of sewing).

The guiding device in accordance with the present invention is intended to guide the piece of fabric which rests on the plate 4 in order to permit obtaining a stitching line parallel to the edge of the fabric without the help of an operator.

This guiding device is mounted on a pneumatic jack 7 whose body 7*a* is attached by means of an element 8 to the bed 3 of the machine and whose mobile rod 7*b* is fixedly attached at its end to a support bracket 9 of the guiding device. The jack 7 is slightly inclined to the vertical position so as to enable displacement of the guiding device between a working position (FIG. 1) where this latter is situated just in front of the presser-foot 5 and needle 6 of the machine and a lifted position (FIG. 2) where the front parts of these elements are completely disengaged. The movement of the jack is guided by rods 23 permitting the guiding device to perform a translational movement without any angular movement. In the low position, the guiding device is located in front of the presser-foot 5 in the vicinity of the above mentioned angle of the support plate 4.

In the exemplified embodiment, the presser-foot 5 is attached to a cable 10 (which is better seen in FIG. 7) which passes through an eye provided in the support bracket 9 and has at its upper free end a contact plate which automatically lifts the presser-foot when the guiding device reaches its lifted position.

Moreover, the machine is provided with an optical detector 11 of the presence of the fabric, capable of capturing the light reflected by a small plate 11*a* situated near the presser-foot 5 (towards the inside of the fabric, i.e. near the edge Rb); when the fabric appears at its level, this detector actuates the jack 7 and causes the downwards movement of the guiding device towards the working position; when the fabric disappears, it actuates the lifting movement of the jack 7. In addition, a proximity pin (not seen) is provided on the jack 7 in order to detect the moment when the rod reaches its low deployed position corresponding to the working position of the guiding device. The pin actuates the start of the sewing machine when the guiding device reaches its working position; it also actuates the start of the means for entrainment and rotation of the rolling element of this device and that of the actuator of the alternating pivoting movement.

As illustrated in the figures, the guiding device comprises essentially the following five functional assemblies:

- a rolling element 12 comprising a sphere of elastic material supported by a mobile bracket 13 and which, in the working position, is situated in front of the presser-foot 5 in such a manner as to contact the fabric by entrainment generatrices (creating a rolling band BR represented by dashed lines in the figures), this contact being effected at the level of the rounded edge Ra of the support plate of the sewing machine in the immediate vicinity of the other edge Rb,
- an actuator 14 for alternating pivoting movement comprising a rotating displacement device whose body 14*a* is attached to the support 9 and whose rod 14*b* bears a mobile bracket 13 enabling it to cause the sphere 12 to pivot between two extreme positions, in which the entrainment generatrices BR define two different directions (whose traces have been represented in $D_1$ and $D_2$ on the working plate),
- means for rotating the sphere 12 comprising an electrical drive motor 15 and cylinder 16 bearing against the surface of the sphere 12,
- an optical detector 17 (FIG. 3) mounted in front of the presser-foot 5 transversely displaced with respect thereto towards the interior of the support plate, in order to detect the presence or absence of the fabric at this level, this detector being associated with a circuit 18 for actuation and amplification creating an electric position signal in two states $S_p$; which is connected with an electropneumatic distributor 19 actuating the rotating displacement device 14,
- a detector of the extreme positions 24 associated with the rotating displacement device 14 and constituted by two proximity projecting pins 24*a* and 24*b* situated with respect to the end-of-course stops 14*c* and 14*d* of the rotating displacement device, in order to deliver a signal when the stops are situated in front of the pins (this position corresponding to the two extreme angular positions of the rod of the rotating displacement device and thus of the sphere 12 attached to the latter).

The specific structural and functional characteristics of these different assemblies are described in detail below.

The sphere 12 which may be a hollow rubber ball is transversely displaced with respect to the presser-foot 5 in such a manner as to contact the fabric in a zone nearer to the edge Rb than the presser-foot. This sphere is attached by a lateral calotte of its surface on a substantially horizontal support shaft 21 which rotates in an opening of the mobile bracket 13 in such manner that said sphere is free to turn around an axis XX' passing through its centre O.

The mobile bracket 13 is fixedly attached to the rod 14*b* of the displacement device 14 in such manner that the extension of the vertical axis YY' of said rod passes through the centre O of the sphere. Thus, the pivoting movement imposed by the displacement device modifies the orientation of the axis XX' around which the sphere turns without changing its spatial position.

The sphere 12 is arranged vertically with respect to the rounded edge Ra of the work support plate 4, in such manner that its center (O) slightly exceeds the edge of said plate as illustrated in FIGS. 7 to 10; the sphere and the rounded edge define in their contact zone a common tangent Tc inclined with respect to the horizontal. Thus the fabric is entrained by the sphere at the level of the bend which it forms at the rounded edge Ra; at the level of this bend the fabric has greater rigidity which contributes to reduce the risks of creasing, even in the case of very light fabrics.

Blowing means 27 are provided underneath the rounded edge Ra of the support plate in order to disengage the fabric from the vertical edge of said plate and thus put it in a better position for being entrained by the sphere 12. Moreover, the support plate 4 comprises preferably a small rounded flank 28 situated underneath the edge Rb in the vicinity of the sphere 12. Such guidance of the fabric improves the conditions of entrainment of this latter by the sphere 12.

The rotating displacement device 14 is a pneumatic displacement device of known type, with adjustable angular amplitude; owing to its low inertia it is capable of changing position at an elevated frequency higher than 5 pivoting movements per second and may even reach 10 to 15 pivoting movements per second. This device comprises end-of-course stops 14*c* and 14*d* which permit the control of its pivoting amplitudes to a value $2\alpha$ of the order of 20° to 30° especially to a value of about 24°. As already indicated, these stops serve to detect the moments when the rotating device reaches one or the other of the extreme angular positions (owing to the proximity pins 24*a*, 24*b*). In one angular position, the rotation axis XX' of the sphere is displaced by an angle $\alpha = 12°$ with respect to the transverse direction (FIGS. 3, 4 and 11), while in the other angular position, this axis of rotation XX' is symmetrically displaced with respect to the said transverse direction at an equal angle (FIGS. 5 and 12). Thus in the first position, the entrainment generatrices BR of the sphere define a direction $D_1$ angularly displaced towards the interior of the fabric by the angle $\alpha$ with respect to the longitudinal direction, in such manner that the rotation of the sphere guarantees a longitudinal entrainment of the fabric with a smaller transversal component directed towards the inside of the fabric (FIG. 11); in the second position, the entrainment generatrices BR define a direction $D_2$ angularly displaced towards the edge B of the fabric by the angle $\alpha$ and the rotation of the sphere ensures a longitudinal entrainment with a smaller transverse component directed towards the edge (FIG. 12).

The entrainment cylinder 16 causing rotation of the sphere is situated above the sphere 12 along a transverse horizontal axis ZZ' in such a manner as to bear against the upper zone of said sphere (upper pole Su of the sphere) opposite the lower contact zone of the sphere with the fabric. This upper zone Su of contact between the cylinder 16 and the sphere 12 is situated on the vertical axis YY' passing through the centre O, around which the sphere is made to pivot in alternative manner by the actuating device 14. Zone Su does not move during this pivoting movement so that whatever the entrainment friction between the cylinder and the sphere, the contact of the latter does not interfere with the performance of the pivoting movement.

The cylinder 16 is supported by the moving shaft 22 of the electric motor 15, this shaft being situated above the shaft bearing the sphere 12. For this purpose, the motor 15 is attached at the rear of the support 9 and its moving shaft 22 passes through a hollow space provided in the mobile bracket 13.

The detector 17 is an optical detector of conventional type, which captures the light reflected by a platelet 17*a* supported by the work support plate 4. Preferably, the optical detector 17 is associated with control means for controlling the transverse position in order to permit the adjustment of the position of the stitching line with respect to the edge of the fabric. In the longitudinal sense, detector 17 is arranged between the presser-foot 5 and the rolling sphere 12 which corresponds to an optimal efficiency of guiding.

The optical signal delivered by the detector 17 is converted by a cell into an electric signal which is processed by the circuit 18 in order to send a position signal Sp towards an electropneumatic distributor 19 associated with the rotating device 14. In the presence of the fabric, the signal Sp assumes a state, designated as State 1, corresponding to that position of the sphere 12 for which its entrainment generatrices define a direction $D_1$: the fabric is longitudinally entrained with a tendency to slide transversally in a direction opposite to its edge (FIG. 11); the platelet detector 17*a* which was covered by the fabric is now exposed. The detector 17 thereupon detects the absence of the fabric and the signal $S_p$ passes to its second state, designated State 2, corresponding to the position of the sphere 12 in which the entrainment generatrices define the direction $D_2$: the fabric is still entrained longitudinally but with a tendency to slide transversally in the direction towards its edge (FIG. 12). Thus, by pivoting the axis of rotation XX' of the sphere at each change of state of the position signal $S_p$, the fabric is guided in such a manner that its edge passes substantially above the platelet 17*a*, i.e. it remains at a substantially constant transverse distance from the presser-foot 5.

When the signal $S_p$ changes its state very rapidly (the edge of the fabric vertically displaced with respect to the platelet 17*a*), the rotating device 14 actuated from one side and from the other side at a high frequency, oscillates between the above mentioned two extreme positions: FIGS. 6 and 13 illustrate these alternative pivotings which may reach an elevated frequency (higher than 5 hertz). During this oscillation, the entrainment generatrices BR of the sphere 12 entrain the fabric along a resultant direction Dc parallel to the line of sewing. In this case, the detector of the extreme positions 24 does not deliver any signal.

The pins 24*a*, 24*b* of the detector of the extreme positions 24, are connected by signal generating means 25 which upon receipt of a signal, create a signal Pe in two states (for example State 1 in the case of detection of the extreme stable position and state 0 in the contrary case corresponding to an oscillation between the extreme positions). This signal is delivered to the actuating means 26 which actuate the driving motor 15 of the cylinder 16. This motor is an electric motor with 2 speeds, one slow capable, for example, of making the sphere turn at 100 rotations per minute, the other rapid capable of making the sphere turn at 103 rotations per minute. The actuating means 26 cause rapid rotation when the signal Pe represents an extreme position and low speed in the contrary case.

The guiding device in accordance with the present invention thus entrains the fabric in front of the sewing zone in a generally longitudinal direction and guides it permanently by creating a transverse component when necessary in order to obtain a seam parallel to its edge; this entrainment co-operates with that of the presser-foot in order to avoid the risk of pleating, creasing, etc. In FIGS. 11 and 12, the edge of the fabric is represented by B, C represents the desired line of sewing and, as already indicated, $D_1$ and $D_2$ are the entrainment directions of the fabric by the sphere 12 when this latter is in the two extreme opposed positions; these entrainment directions $D_1$ and $D_2$ are symmetrical with respect to the longitudinal direction Dc (this latter being parallel to the entrainment direction of the presser-foot). In FIG. 13, the sphere is schematically represented when about to oscillate between the two extreme positions (the average entrainment direction being the direction Dc).

When the entrainment directions $D_1$ and $D_2$ are angularly inclined with respect to the longitudinal direction (FIGS. 11 and 12), the entrainment speed Vr of the fabric is greater (rapid speed of the motor) so that the component Vl along the longitudinal direction remains equal to the speed V' corresponding to the slow speed (FIG. 13), at which the fabric is entrained when the average entrainment direction coincides with the longitudinal direction.

Moreover, when the piece of material to be sewn arrives at the end of the sewing and its outer edge is beyond the sphere 12 (in which case it is not entrained by the latter), the fabric is guided by an elastic tongue 29 situated in the transverse direction between the sphere 12 and the presser-foot 5 as shown in the figures, this tongue bearing elastically on the fabric, avoids transverse sliding of the latter at the end of sewing. This tongue 29 may be mobile vertically and designed in such a manner as not to descend against the fabric until the end of the sewing when the end of the fabric arrives near the sphere 12.

The device described above may be used in any application where a seam has to be made along the edge of a fabric in order to make this operation automatic. If several sheets of fabric have to be sewn, a guiding device is provided for each such sheet.

We claim:

1. A fabric guiding device mounted on a sewing machine provided with a support plate (4) for fabric and a presser-foot (5) for entrainment of the fabric associated with at least one needle (6), in order to permit automatically sewing pieces of fabric parallel to a predetermined reference line, the device comprising:

a rolling element (12) for entrainment of the fabric, mounted in front of the presser-foot (5) and free to rotate around a substantially horizontal axis of rotation (XX') in such a manner as to contact the fabric along entrainment generatrices (BR) situated in a vertical plane, a pivoting actuator (14) on which said rolling element (12) is mounted, for pivoting said rolling element about the vertical axis (YY'), intersecting the rotation axis (XX') in such manner as to direct the entrainment generatrices (BR) in correspondence with different advancement directions ($D_1$, $D_2$), a cylinder (16) situated along a transverse horizontal axis (ZZ') and bearing against the rolling element in order to make the rolling element turn around its axis of rotation (XX'), by frictional contact, a drive-motor (15) for causing rotational movement of the cylinder (16), a detector (17) of the transverse position of the fabric, mounted in front of the presser-foot (5) and associated with means (18) for generating a position signal (Sp) and with control means (19) for actuating pivoting of the rolling element as a function of the position signal (Sp), said guiding device being characterized in that the cylinder (16) is situated above the rolling element (12) in such manner as to bear against the upper zone (Su) of said rolling element, opposite the lower contact zone (Si) of said element with the fabric, said upper zone (Su) of said rolling element where contact occurs between the cylinder and the rolling element being situated substantially on the axis (YY') around which the alternative pivoting of said rolling element occurs.

2. A device according to claim 1, characterized in that:

an orientation detector (24) is associated with one of the group consisting of the pivoting actuator (14) and the rolling element (12), said detector being connected with signal generating means (25) adapted to deliver a signal (Pe) representative of the direction of entrainment of the generatrices (BR) of the rolling element, the drive motor (15) of the cylinder (16) is connected with actuating means (26) receiving the signal (Pe) emitted by the above mentioned signal generating means (25), said actuating means being adapted to adjust the speed of the motor (15) as a function of this signal.

3. A device according to claim 2, permitting automatic sewing of a piece of fabric along one of its edges constituting said reference line, characterized in that:

the position detector (17) is a detector of the presence or absence of the fabric, associated with means for generating a position signal (Sp) in two representative states of presence and absence of the fabric, the pivoting actuator (14) is an actuator of alternating pivoting, capable of causing the rolling element to pivot alternatively between two extreme positions, at a frequency exceeding 5 pivoting movements per second, the entrainment generatrices presenting, in the two extreme positions, two directions ($D_1$, $D_2$) substantially symmetrical with respect to the direction (Dc) parallel with the entrainment direction of the fabric by the presser-foot, the control means (19) of the pivoting actuator (14) being adapted to actuate the pivoting actuator alternatively from one position to the other at each change of state of the position signal (Sp), the orientation detector (24), is a detector of the extreme positions (24*a*, 24*b*), associated with the pivoting actuator (14), the signal generating means (25) being adapted to deliver a signal of extreme position (Pe) when said actuator is in one or other of its extreme positions, the electric drive-motor (15) of the cylinder (16) is of the type having two rotation speeds, one designated as slow and the other as rapid, the actuating means (26) associated with the motor (15) being adapted to actuate the rapid rotation of the motor in the presence of a signal of the extreme position (Pe) and the slow rotation in the absence of said signal.

4. A device according to claim 3, characterized in that the motor (15) and its actuation means (26) are adapted in such manner that the slow speed of rotation of the rolling element (12) causes a speed of movement of the fabric substantially equal to that created by the presser-foot and that the rapid speed of that rolling element (12) creates a speed of movement of the order of 1% to 5% higher than the first speed.

5. A device according to claim 1, characterized in that the rolling element (12) comprises a sphere of elastic material adapted by a lateral calotte of its surface to a support shaft (21), said support shaft being mounted on the actuator (14) in such manner as to turn around a horizontal axis (XX') passing through the center (0) of the sphere (12), said center (0) of the sphere (12) and the upper zone (Su) of contact of the cylinder (16) with the sphere (12) being substantially aligned on the vertical axis (YY') around which the alternative pivoting of said sphere is effected.

6. A device according to claim 5, characterized in that the actuator of the alternative pivoting movement comprises a rotating displacement device (14) with a substantially vertical rod (14*b*) and a bracket (13) attached to said rod and supporting the shaft (21) of the sphere, said bracket being provided with an opening for permitting passage of the shaft 22 of the motor, bearing the entrainment cylinder 16), this shaft (22) of the motor being arranged above the bearing shaft (21) of the sphere.

7. A device according to claim 6, characterized in that the rotating displacement device (14) is a device with an angular amplitude adjustable to a value $2\alpha$ of the order of 20° to 30°, said device having a weak inertia owing to which it has a pivoting frequency higher than 5 hertz.

8. A device according to claim 5, characterized in that the sphere (12) constituting the rolling element is made of elastic material and mounted in front of the presser-foot (5) vertically with respect to the rounded edge (Ra) of the working plate (4), the center (0) of said sphere being slightly displaced beyond the edge of the plate in such manner that the sphere and the rounded edge define in their contact zone a common tangent (Tc) inclined with respect to the horizontal.

9. A device according to claim 8, characterized in that it comprises blowing means (27) situated underneath the rounded edge (Ra) of the support-plate (4) in order to disengage the fabric from the vertical edge of said plate.

10. A device according to claim 8, in which the detector (17) is an optical detector of the absence or presence of the fabric, characterized in that the presser-foot (5) is disposed near an angle of the support plate, this angle being limited by the rounded edge (Ra) on top of which is situated the sphere (12) and by an edge perpendicular to the preceding one and parallel to sewing line, the optic detector (17) of the presence or absence of the fabric being situated towards the interior of the support plate (4) in the vicinity of the presser-foot (5).

11. A device according to claim 1, characterized in that it comprises an elastic tongue (29) disposed in the transverse direction between the rolling element (12) and the presser-foot (5) in order to bear against the fabric and avoid transverse sliding of the fabric at the end of the sewing operation.

12. A device according to claim 1, characterized in that it is mounted on a mobile lifting/lowering element of a jack (7) whose body is attached to the bed (3) of the sewing machine, in order to permit lowering said device to working position in front of the needle, or lifting it to an elevated position so as to clear the space in front of that needle.

13. A guiding device according to claim 1, mounted on a sewing machine of the type with the head at the left side.

14. A process of automatic sewing of a piece of material by means of a sewing machine equipped with a device according to claim 1, in which a rolling element (12), orientable by pivoting around a vertical axis (YY'), is disposed to bear against the fabric in front of the presser-foot in such a manner as to guide and entrain the fabric in front of the sewing zone, said process comprising: rotating said rolling element by means of a cylinder (16) bearing against said element in its upper zone (Su) traversed by a vertical pivoting axis (YY') in such manner that the contact of the cylinder (16) and the rolling element (12) leaves this latter free to pivot around the axis (YY') independently of the friction coefficient between the cylinder and the rolling element.

15. A process according to claim 14, comprising: rotating the cylinder at a speed which is a function of the orientation of the rolling element (12) in such manner that said element causes a speed of advance of the fabric whose projection on the sewing line is substantially equal to the speed of displacement provided by the presser-foot (5) in the sewing zone.

16. A process according to claim 14, comprising: orienting the rolling element (12) by alternative pivoting movement between two extreme angular positions.

* * * * *